US010978263B1

(12) United States Patent
Cuppett et al.

(10) Patent No.: US 10,978,263 B1
(45) Date of Patent: Apr. 13, 2021

(54) COUPLING SYSTEM FOR INTERRUPTER-CONDUCTOR CONNECTION IN HIGH VOLTAGE CIRCUIT BREAKERS

(71) Applicant: ABB Schweiz AG, Baden (CH)

(72) Inventors: Matthew D. Cuppett, Uniontown, PA (US); Brian Christopher, Smithfield, PA (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/842,216

(22) Filed: Apr. 7, 2020

(51) Int. Cl.
*H01H 31/20* (2006.01)
*H01H 33/12* (2006.01)

(52) U.S. Cl.
CPC ..... *H01H 33/127* (2013.01); *H01H 31/20* (2013.01)

(58) Field of Classification Search
CPC ..... H01H 33/127; H01H 33/10; H01H 33/56; H01H 33/7038; H01H 33/7053; H01H 33/7061; H01H 33/74; H01H 33/78; H01H 33/95; H01H 31/20; H01H 31/00
USPC ..... 218/12, 13, 16, 55, 57, 59, 61, 67, 68, 218/79, 80, 97
See application file for complete search history.

(56) References Cited

U.S. PATENT DOCUMENTS 3,953,818 A * 4/1976 Martin ..... H01F 27/402 337/191
4,442,329 A * 4/1984 Gray ..... H01H 33/022 218/71
5,478,980 A 12/1995 Freeman et al.
5,495,084 A 2/1996 Meyer et al.
5,723,839 A * 3/1998 Kozawa ..... H01H 33/02 218/43
6,515,248 B2 * 2/2003 Imamura ..... H01H 33/91 218/43
6,630,638 B1 10/2003 Freeman et al.
6,784,392 B1 * 8/2004 Piazza ..... H02B 13/035 218/14
8,378,241 B1 2/2013 Cuppett

* cited by examiner

*Primary Examiner* — William A Bolton
(74) *Attorney, Agent, or Firm* — Sage Patent Group

(57) ABSTRACT

A coupling system for securing an elongated rod to a connector that links the elongated rod to a device, and methods therefor, are disclosed herein. The coupling system includes a swivel member pinned in a receptacle of the connector, and a fastener secured to the swivel member. The elongated rod is secured to the fastener. The elongated rod may be a conductor rod and the device may be an interrupter for a circuit breaker.

20 Claims, 3 Drawing Sheets

COUPLING SYSTEM FOR INTERRUPTER-CONDUCTOR CONNECTION IN HIGH VOLTAGE CIRCUIT BREAKERS

TECHNICAL FIELD

The present invention generally relates to a coupling system, and more particularly, a coupling system for a conductor to interrupter connection for a high voltage circuit breaker.

BACKGROUND

Electrical devices may include one or more circuit interrupters to interrupt fault currents and prevent the occurrence of an arc fault. For example, a dead tank circuit breaker may have bushings that extend from an outer surface of the tank, and a conductor extends through the length of each bushing for connection to the circuit interrupter. In certain designs, the attachment between the circuit interrupter and the conductor is made by clamping the conductor to the circuit interrupter connection. Known methods of attaching the conductor present difficulty in maintaining the desired contact between the conductor and the circuit interrupter connection. Therefore, further improvements in this area are needed.

SUMMARY

One embodiment of the present disclosure is a unique coupling system for a conductor to interrupter connection in a circuit breaker. Other embodiments include apparatuses, systems, devices, hardware, methods, and combinations for coupling system components. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
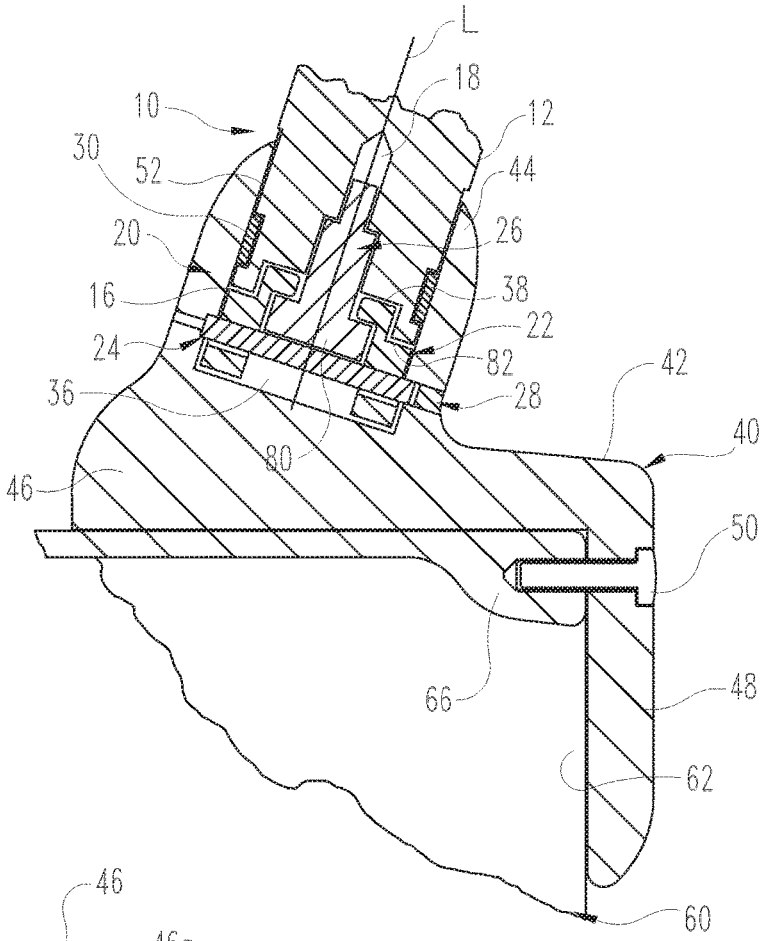
FIG. 1 is a section view showing one embodiment of the coupling system for the conductor to interrupter connection.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. While illustrative embodiments of the invention are described below, in the interest of clarity, not all features of an actual implementation of the invention may be described herein.

Referring to FIG. 1, in the illustrative embodiment, a system 10 is shown in which an elongated rod is secured to a connector that links the elongated rod to a device. In one embodiment, the elongated rod is a conductor rod 12 and the device is an interrupter 60 for a circuit breaker (not shown), such as may be employed in a high voltage dead tank circuit breaker. A coupling system 20 is provided that secures the conductor rod 12 to a connector 40 that electrically and mechanically links the conductor rod 12 to the interrupter 60.

Figure 2:
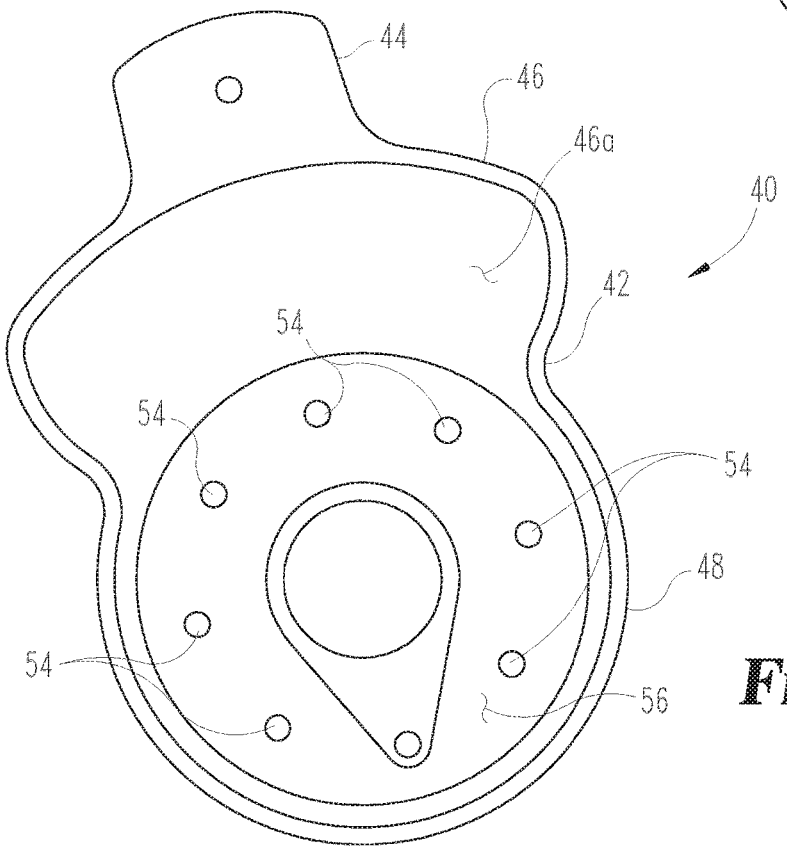
FIG. 2 is a perspective view of a connector for the coupling system of FIG. 1 that links the conductor to the interrupter.
Figure 3:
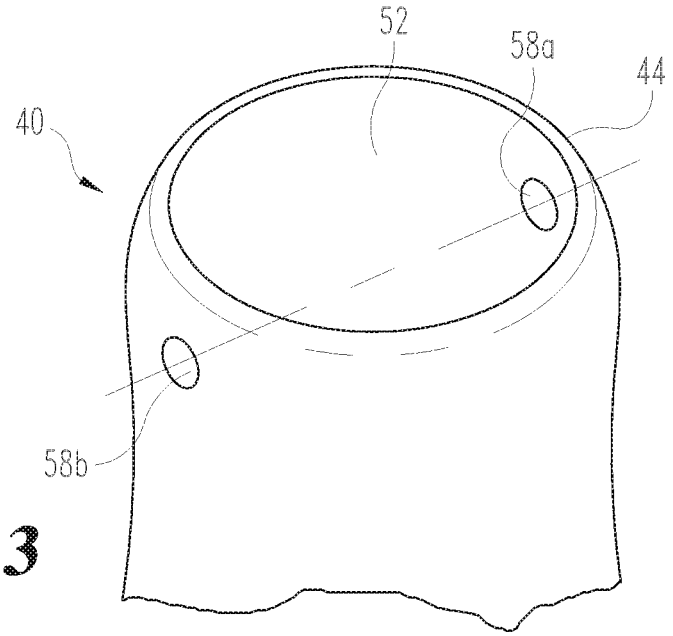
FIG. 3 is a perspective view of a part of the connector of FIG. 2 showing a passage that receives the conductor.

Referring further to FIGS. 2-3, the connector 40 includes a base 42 with an extension 44 that defines a receptacle 52 for receiving the conductor rod 12. Base 42 includes an L-shape in the illustrated embodiment, although other shapes are also contemplated. The L-shaped base 42 includes a first leg 46 and a second leg 48 extending transversely to the first leg 46 away from extension 44. The extension 44 extends outwardly from first leg 46 at an oblique angle. The bottom surface 46*a* of first leg 46 can be concavely curved to sit against a curved tank or other curved structure, but other shapes, including non-curved shapes, are also contemplated. The extension 44 includes aligned bores 58*a*, 58*b* that are oriented transversely to a longitudinal axis of conductor rod 12, as discussed further below.

Second leg 48 defines a circular cup shape to fit one the end of the interrupter 60. Second leg 48 includes a number of holes 54 in the end plate 56 thereof to receive fasteners 50. Fasteners 50 secure the connector 40 to the interrupter 60. The second leg 48 can be secured to a back or rearward end of the interrupter 60, as shown in FIG. 1.

Figure 4:
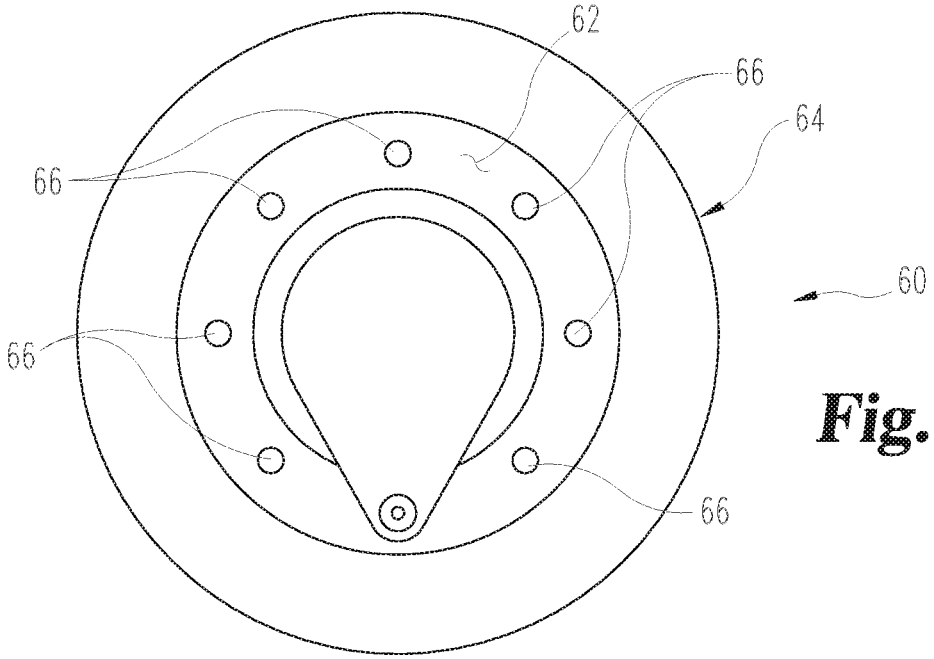
FIG. 4 is an elevation view of the location on the back of the interrupter for the conductor to interrupter connection of FIG. 1.
Figure 6:
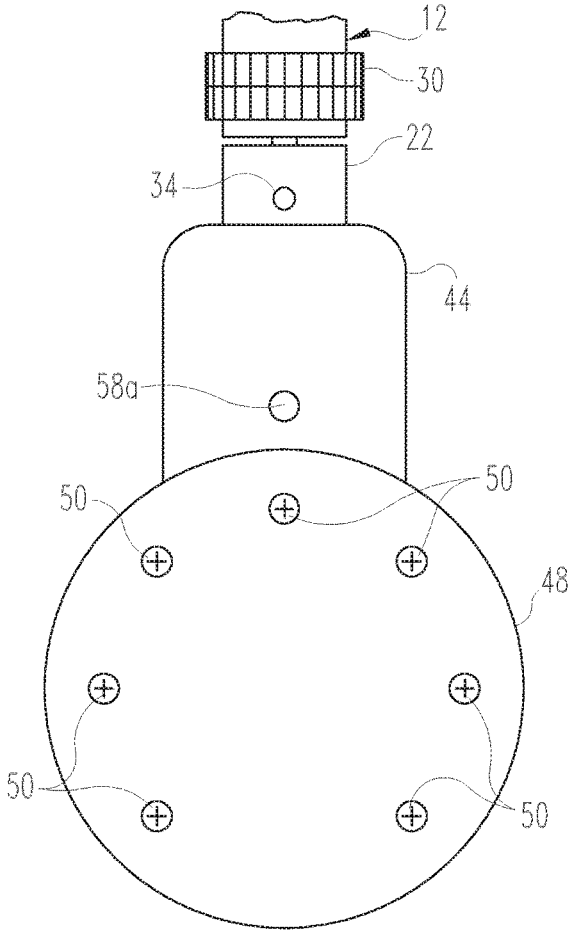
FIG. 6 is an elevation view showing partial insertion of the conductor into the receptacle of the connector.
Figure 7:
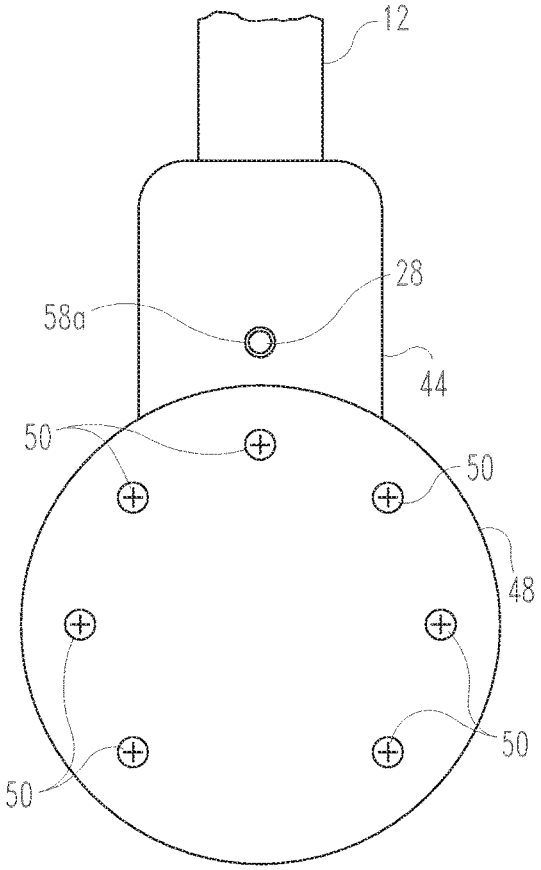
FIG. 7 is an elevation view showing final insertion of the conductor into the receptacle of the connector.

One example of a back end of an interrupter 60 is shown in FIG. 4. The interrupter 60 may be located in a tank 64, and includes a rear face 62 for attachment to second leg 48 of connector 40. Rear face 62 includes a number of holes 66 that receive fasteners 50 extending though second leg 48 to secure the connector 40 to interrupter 60, as shown in FIGS. 1, 6 and 7.

As shown in FIG. 1, the coupling system 20 includes a swivel member 22 in receptacle 52, a pin 24 extending through the swivel member 22, a fastener 26 to which the swivel member 22 is mounted, and a retainer 28 (such as a set screw) for securing the pin 24 in position. An electrical contact 30 is positioned around the conductor rod 12. In one embodiment, the electrical contact 30 is a flexible bracelet that includes multiple linked components of conductive material that are capable of flexing inwardly during insertion of conductor rod 12 and grip or contact the inner surface of extension 44 in receptacle 52 and the outer surface of conductor rod 12.

Figure 5:
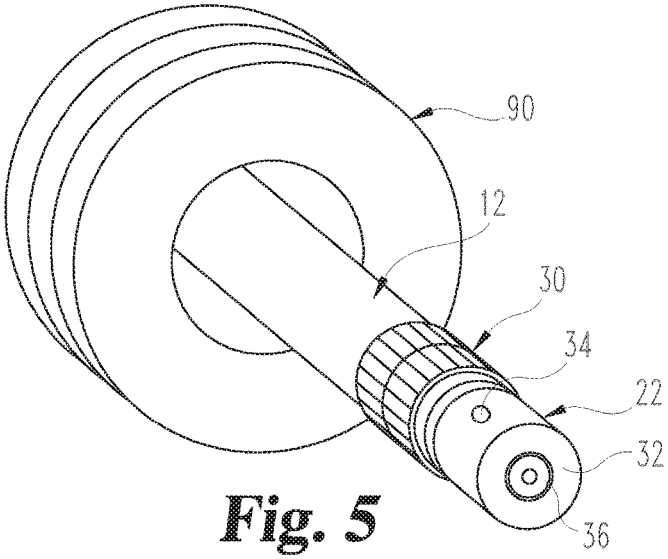
FIG. 5 is a perspective view of the end of the conductor that is positioned in the receptacle of the connector and a part of the bushing that receives the conductor.

Referring to FIGS. 1 and 5, swivel member 22 includes a cylindrical body 32 with an axial bore 36 for receiving fastener 26 and a transverse passage 34 extending therethrough for receiving pin 24. Swivel member 24 further includes inner shoulder 38 that abuts a head 80 of fastener 26 to axially retain the swivel member 24 on fastener 26. Swivel member 24 also includes an outer shoulder 82 that aligns with a first end 16 of conductor rod 12. Swivel member 24 need not be in abutting engagement with first end 16, but such engagement is not precluded. Furthermore, swivel member 24 can be spaced from the inner surfaces of extension 44 to allow some pivoting of conductor rod 12 relative to extension 44 transversely longitudinal axis L about pin 24.

Fastener 26 extends into an end opening 18 of conductor rod 12 along a longitudinal axis L of conductor rod 12. Fastener 26 can include threads or other suitable structure for engagement with conductor rod 12 to axially restrain the conductor rod 12 to fastener 26. The swivel member 22 is axially secured to extension 44 with pin 24 extending through passage 34 of swivel member and into aligned bores 58*a*, 58*b* of extension 44. Retainer 28 is secured in bore 58*a* to prevent the pin 24 from becoming dislodged from passage 34 and bores 58*a*, 58*b*.

During assembly, the swivel member 22 can be secured at first end 16 of conductor rod 12 with fastener 26, as shown in FIG. 5. Electrical contact 30 is positioned around conductor rod 12 adjacent the first end 16. Conductor rod 12 can be configured to extend through a bushing, such as bushing 90. As shown in FIG. 6, the secured swivel member 24 is inserted into receptacle 52 of extension 44, and conductor rod 12 is rotated to align passage 34 with bores 58*a*, 58*b* of extension 44.

When the conductor rod 12 is fully inserted into extension 44 with passage 34 aligned with bores 58*a*, 58*b*, the pin 24 is inserted into bore 58*a*, through passage 34, and into bore 58*b*. The bore 58*b* can include a stepped profile that only allows partial insertion of pin 24 therein. The retainer 28 is then engaged to bore 58*a* to retain the pin 24 in the bores 58*a*, 58*b* and passage 34. Conductor rod 12 is therefore axially secured to extension 44 of connector 40, and electrically linked to the interrupter 60 via the electrical contact 30.

Various aspects of the present disclosure are contemplated. According to one aspect, a system includes an elongated rod, a connector including a receptacle for receiving a first end of the elongated rod, and a coupling system in the receptacle of the connector for coupling the elongated rod to the connector. The connector includes a base for connection to a device to be linked with the elongated rod. The coupling system includes a fastener secured to the first end of the elongated rod, a swivel member mounted to the fastener, and a pin securing the swivel member to the connector in the receptacle. An electrical contact positioned around the first end of the elongated rod and in engagement with the connector in the receptacle.

In one embodiment, the elongated rod includes an axially extending opening in the first end thereof and the fastener is secured to the elongated rod in the opening. In one embodiment, the elongated rod is threadingly engaged to the fastener. In one embodiment, the elongated rod is a conductor and the device is an interrupter for a circuit breaker.

In one embodiment, the connector includes a tubular extension extending outwardly from the base and the extension defines the receptacle, and the pin is located in a pair of aligned bores of the extension so that the pin extends transversely to the longitudinal axis through the swivel member for engagement in the aligned bores of the extension, and the swivel member can rotate about the pin transversely to the longitudinal axis. In one embodiment, the coupling system includes a retainer engaged to one of the pair of aligned bores for securing the pin to the extension in the aligned bores of the extension.

In one embodiment, the base is L-shaped and the elongated rod extends outwardly from a first leg of the base and a second leg of the base extends away from the elongated rod transversely to the first leg for connection to the device. In one embodiment, the second leg is cup-shaped and includes an end plate with a number of holes for receiving fasteners to secure the connector to the device. In one embodiment, the electrical contact is a flexible bracelet. In one embodiment, the electrical contact includes multiple spiral/spring contacts.

In another aspect, a coupling system for connecting a conductor rod to an interrupter is disclosed. The coupling system includes a connector including a receptacle for receiving a first end of the conductor rod and a base for connection to the interrupter. The coupling system also includes a swivel member in the receptacle of the connector and a pin for securing the swivel member to the connector in the receptacle. The coupling system includes a fastener secured to the swivel member in the receptacle and the conductor rod is engageable to the fastener. An electrical contact is positioned around the first end of the elongated rod in engagement with the connector in the receptacle.

In one embodiment, the fastener is secured in an end opening of the conductor rod. In one embodiment, the fastener is threadingly engaged to the conductor rod. In one embodiment, the connector includes a tubular extension extending outwardly from the base and the extension defines the receptacle, and the pin is located in a pair of aligned bores of the extension so that the pin extends transversely to the conductor rod through the swivel member for engagement in the aligned bores. In one embodiment, a retainer is engaged to one of the pair of aligned bores for securing the pin to the extension in the aligned bores.

In one embodiment, the base is L-shaped and the receptacle extends outwardly from a first leg of the base and the second leg of the base extends transversely to the first leg away from the receptacle. In one embodiment, the electrical contact is a flexible bracelet.

According to another aspect, a method for connecting a conductor rod to an interrupter includes: engaging a swivel member to a first end of the conductor rod with a fastener; positioning the first end of the conductor rod in a receptacle of a connector so that a passage through the swivel member is aligned with bores of the connector and an electrical contact around the elongated rod is positioned in the receptacle in engagement with the connector; and inserting a pin through the aligned bores of the connector and the passage of the swivel member to axially secure the conductor rod to the connector in the receptacle.

In one embodiment, the method includes engaging the connector to the interrupter. In one embodiment, the fastener is threadingly engaged in an axially extending bore in the first end of the conductor rod and the swivel member is mounted on an end of the fastener. In one embodiment, the method includes securing the pin in the aligned bores of the connector and the passage of the swivel member with a retainer engaged in one of the bores of the connector.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system comprising:

an elongated rod extending along a longitudinal axis from a first end of the elongated rod;

a connector including a receptacle for receiving the first end of the elongated rod, the connector including a base for connection to a device to be linked with the elongated rod;

a coupling system in the receptacle of the connector for coupling the elongated rod to the connector, the coupling system including:

a fastener secured to the first end of the elongated rod;

a swivel member mounted to the fastener;

a pin securing the swivel member to the connector in the receptacle; and an electrical contact positioned around the first end of the elongated rod and in engagement with the connector in the receptacle.

2. The system of claim 1, wherein the elongated rod includes an axially extending opening in the first end thereof and the fastener is secured to the elongated rod in the opening.

3. The system of claim 2, wherein the elongated rod is threadingly engaged to the fastener.

4. The system of claim 1, wherein the elongated rod is a conductor and the device is an interrupter for a circuit breaker.

5. The system of claim 1, wherein the connector includes a tubular extension extending outwardly from the base and the extension defines the receptacle, and the pin is located in a pair of aligned bores of the extension so that the pin extends transversely to the longitudinal axis through the swivel member for engagement in the aligned bores of the extension, wherein the swivel member can rotate about the pin transversely to the longitudinal axis.

6. The system of claim 5, wherein the coupling system includes a retainer engaged to one of the pair of aligned bores for securing the pin to the extension in the aligned bores of the extension.

7. The system of claim 1, wherein the base is L-shaped and the elongated rod extends outwardly from a first leg of the base and a second leg of the base extends away from the elongated rod transversely to the first leg for connection to the device.

8. The system of claim 7, wherein the second leg is cup-shaped and includes an end plate with a number of holes for receiving fasteners to secure the connector to the device.

9. The system of claim 1, wherein the electrical contact is a flexible bracelet.

10. A coupling system for connecting a conductor rod to an interrupter, the coupling system comprising:

a connector including a receptacle for receiving a first end of the conductor rod, the connector including a base for connection to the interrupter;

a swivel member in the receptacle of the connector;

a pin for securing the swivel member to the connector in the receptacle;

a fastener secured to the swivel member in the receptacle, wherein the conductor rod is engageable to the fastener; and an electrical contact positioned around the first end of the conductor rod and in engagement with the connector in the receptacle.

11. The coupling system of claim 10, wherein the fastener is secured in an end opening of the conductor rod.

12. The coupling system of claim 11, wherein the fastener is threadingly engaged to the conductor rod.

13. The coupling system of claim 10, wherein the connector includes a tubular extension extending outwardly from the base and the extension defines the receptacle, and the pin is located in a pair of aligned bores of the extension so that the pin extends transversely to the conductor rod through the swivel member for engagement in the aligned bores.

14. The coupling system of claim 13, further comprising a retainer engaged to one of the pair of aligned bores for securing the pin to the extension in the aligned bores.

15. The coupling system of claim 10, wherein the base is L-shaped and the receptacle extends outwardly from a first leg of the base and a second leg of the base extends transversely to the first leg away from the receptacle.

16. The coupling system of claim 10, wherein the electrical contact is a flexible bracelet.

17. A method for connecting a conductor rod to an interrupter, the method comprising:

engaging a swivel member to a first end of the conductor rod with a fastener;

positioning the first end of the conductor rod in a receptacle of a connector so that a passage through the swivel member is aligned with bores of the connector and an electrical contact around the elongated rod is positioned in the receptacle in engagement with the connector; and inserting a pin through the aligned bores of the connector and the passage of the swivel member to axially secure the conductor rod to the connector in the receptacle.

18. The method of claim 17, further comprising engaging the connector to the interrupter.

19. The method of claim 17, wherein the fastener is threadingly engaged in an axially extending bore in the first end of the conductor rod and the swivel member is mounted on an end of the fastener.

20. The method of claim 17, further comprising securing the pin in the aligned bores of the connector and the passage of the swivel member with a retainer engaged in one of the bores of the connector.

* * * * *